US006505892B1

(12) United States Patent
Walker et al.

(10) Patent No.: US 6,505,892 B1
(45) Date of Patent: Jan. 14, 2003

(54) SOFTWALL MINING METHOD AND DEVICE

(76) Inventors: Joseph Chryst Walker, 1112 9th St., Bldg. 43, Albany, CA (US) 94710-1211; Randall D. Peterson, 11602 Colchester Dr., Sandy, UT (US) 84092; Brandon H. Woolley, 473 S. State St. #327, Provo, UT (US) 84606; Jonathan Wayne Wittwer, 960 E. Cedar Ave., Provo, UT (US) 84604; Joel Brian Mundt, 324 W. 400 N., Provo, UT (US) 84601; Jesse Tate Olson, 2365 N. 1000 E., Provo, UT (US) 84604; Brian Douglas Gate, 1127 E. 960 South #15, Provo, UT (US) 84606; Nathan L. Baker, 762 W. 2260 N., Lehi, UT (US) 84043; K. S. Mortensen, 265B CTB Brigham Young University, P.O. Box 24102, Provo, UT (US) 84602-4102

( * ) Notice: Subject to any disclaimer, the term of this patent is extended or adjusted under 35 U.S.C. 154(b) by 0 days.

(21) Appl. No.: 09/609,568

(22) Filed: Jun. 30, 2000

Related U.S. Application Data

(63) Continuation-in-part of application No. 09/287,885, filed on Apr. 7, 1999, now Pat. No. 6,086,159, which is a continuation-in-part of application No. 08/851,680, filed on May 6, 1997, now abandoned.

(51) Int. Cl.[7] ..... E21C 27/40

(52) U.S. Cl. ..... 299/32; 299/31; 299/33; 405/145

(58) Field of Search ..... 405/145, 300, 405/302; 299/31–33, 42–45

(56) References Cited

U.S. PATENT DOCUMENTS

| | | | | |
|---|---|---|---|---|
| 2,716,025 A | * | 8/1955 | Malloy et al. | 299/33 X |
| 4,095,845 A | * | 6/1978 | Paurat | 299/31 X |
| 4,217,067 A | * | 8/1980 | Lagodka et al. | 299/33 X |
| 6,267,191 B1 | * | 7/2001 | Hettinger | 180/187 |

* cited by examiner

*Primary Examiner*—Heather Shackelford
*Assistant Examiner*—Sunil Singh
(74) *Attorney, Agent, or Firm*—Birdwell, Janke & Durando, PLC

(57) ABSTRACT

A softwall mining method and device. Each of a plurality of mining devices comprise a supporting portion, an earth moving portion and a coupling mechanism for advancing the earth moving portion into a mining face, and for advancing the supporting portion toward the earth moving portion. Supporting portions of the devices are locked together to anchor movement of the earth moving portions, and earth moving portions of the devices are separately locked together to anchor the movement of the supporting portions.

19 Claims, 13 Drawing Sheets

SOFTWALL MINING METHOD AND DEVICE

RELATED APPLICATIONS

This application is a continuation-in-part of Ser. No. 09/287,885, filed Apr. 7, 1999, now U.S. Pat. No. 6,086,159, which is a continuation-in-part of Ser. No. 08/851,680, filed May 6, 1997, now abandoned.

BACKGROUND OF THE INVENTION

1. Field of the Invention

This invention pertains in general to the field of mining and, in particular, to a novel device and method for mining slurryable, shallow mineral deposits with or without earthy overburden in a longwall fashion.

2. Description of the Prior Art

Surface mining is and has historically been employed to recover stratified minerals under overburden to economic depths. Underground mining is traditionally employed when overburden depths exceed those economically removable by surface mining or when major surface disturbance is unacceptable.

Prior inventions have been patented for longwall mining of reserves using trenched entry where overburden is sufficiently competent to bridge over longwall shearing and conveying equipment and where floor strata are competent to withstand mining stresses. (See Simpson, U.S. Pat. No. 4,017,122.) Simpson does not accommodate soft, plastic, fluid, loose, unstable, clayey, sandy, dirt, soil, or similar (earthy) ground conditions often encountered in mining shallow ore deposits. Earthy conditions can allow the mine roof to fall ahead of shield supports or allow the floor to heave up behind the face conveyor ahead of the shield pontoons. This creates safety hazards, dilution of ores, and expensive control installation.

For surface mining and windrow reclaim, it has long been known to sluice the mining face or the mined earth to form a slurry for transport. A sluicing pit is created adjacent a mining pit mined with a dragline or other surface excavator. The excavator drops excavated earth into the sluicing pit. A water canon is provided at the sluicing pit to create a slurry, which is pumped away. As the excavator excavates, however, it moves farther away from the sluicing pit, increasing the time required to move the excavated earth to the pit, or requiring periodic reconstruction of the pit.

Some ores, such as phosphate bearing clay, are accompanied by a high degree of moisture. Traditional sluicing methods adds a significant amount of additional moisture, such that the solids content of the resulting slurry may be only 20 to 30%. Moving so much water is expensive. Moreover, in surface mining of such ores, the water tends to fill the mining pit making it difficult to retrieve the ore with excavating apparatus, such as the dragline.

Some ores, such as phosphate bearing clay, are contained within a horizontal plane that does not follow the inclination of the surrounding geologic strata. Prior art methods have not provided a convenient means for maintaining a horizontal mining plane.

BRIEF SUMMARY OF THE INVENTION

The idea of adapting longwall mining equipment and methods to recover ore from slurryable deposits with earthy overburden is novel. The term "softwall" is a new term applicable to this type of mining.

In particular, the subject invention is directed at phosphate matrix mining. A plurality of elongated, substantially parallel, main trenches extend the full length of area to be mined. The trenches are nominally 1,000 feet apart. Heading trenches substantially perpendicular to the main panel trenches are excavated for placement and removal of the mining equipment. The trenches are formed by excavating the overburden materials to the top surface of the mineral bed. The mineral bed in the trench is separately excavated and beneficially recovered. Trench side wall slopes are as steep as is geologically reasonable and safe to minimize excavation.

Forming a header trench leaves an exposed longwall. The softwall mining equipment is installed in the header trench. The phosphate is then mined, for example, by slurrying the ore as the mining equipment moves in a direction generally parallel to the main panel trenches. The slurried ore flows into the main panel trenches where it is removed to the surface for processing.

The softwall mining equipment includes an outer shell to support the overburden stresses. Forward motion is created by extending a cutting head into the ore reserve and retracting said head in such a manner as to pull the outer shell forward.

Unsupported overburden behind the outer shell is encouraged to fill the cavity. Where backfilling is used, materials are injected through the outer shell. Operation of the softwall equipment and backfilling is performed automatically from controls in the trench or on the surface.

When softwall mining equipment has traveled a predetermined distance to the next header trench, the equipment is removed and placed in another header trench for mining additional ore. Trenches not scheduled for further use would be reclaimed.

Alternatively, the equipment can be repositioned at the exit header and again advanced in the opposite direction to mine the next lower level of the ore seam.

Another alternative would be to utilize several sets of softwall mining equipment in a seam thicker than one set of equipment can mine. The uppermost level would be mined first. Adjacent lower levels would be mined with predetermined horizontal separation distances between sets of equipment.

Yet another alternative, where ore can be slumped, is to position the softwall mining equipment at or near the bottom of the ore seam. With or without forward injection of fluids into the ore seam, the slurried ore would slump into the softwall mining equipment and move into the main panel trenches.

Instead of using parallel main panel trenches and a common header trench, a single main trench can be used with a header constructed in a "T" manner. One set of softwall mining equipment would be placed in each header branch of the "T" with slurried ore feed to the trunk main panel trench.

The equipment can also operate in a spiral fashion following main panel trenches constructed to curl in a continuous pattern through the ore reserve.

In another aspect of the invention, individual softwall mining devices may be locked together to provide for advancing portions of the devices into the mining face without requiring the rear support typically provided by overburden for, e.g., surface mining and windrow reclaim.

In yet another aspect of the invention, selected softwall mining devices employed for, e.g., surface mining or windrow reclaim may be provided with a water canon or other water nozzle for preliminarily wetting the mining face or excavated earth.

Besides the objects and advantages described above, the softwall mining device of the present invention is also believed:

a. to provide a more economical means of mining slurryable ores;

b. to provide a means of removing ores by longwall methods where earthy overburden is present and where it is not;

c. to provide a means of longwall mining without use of panel development and outbye roof support;

d. to provide an alternative means of mining sticky clay ore; and e. to provide a means of mining material varying from solid to liquid phases without special concern for the phase.

DESCRIPTION OF THE PREFERRED EMBODIMENTS OF THE INVENTION

Figure 1:
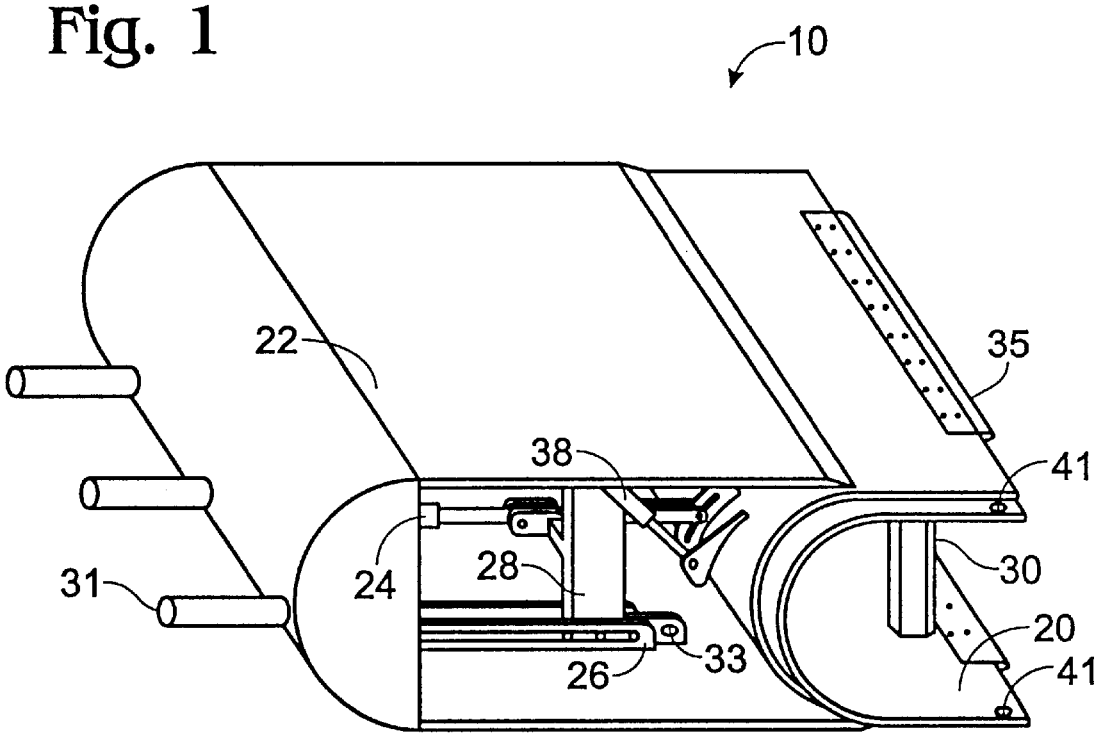
FIG. 1 shows an isometric view of a softwall mining device according to the invention.

A typical embodiment of the softwall mining equipment of the invention is illustrated in FIGS. 1 through 4. FIG. 1 is an isometric schematic view of a softwall mining device 10 according to the invention. The device 10 consists of a face sluicing chamber 20 partially enclosed within a rear and rear bearing support or shell 22. The function of the device 10 is to remove ore matrix away from the ore face. This is accomplished by the forward extension of the face sluicing chamber 20 from within the rear bearing support 22 through the actuation of an extension ram 24. Forward movement is enhanced by the action of a plurality of cutting edge injection nozzles 35 mounted on the face sluicing chamber 20, as also seen in detail in FIG. 4A. Elongated slots 41 are provided to movably join the tongue and grooved edges of the face sluicing chamber 20 together with other softwall mining devices.

Rigidly mounted on the rear bearing support 22, extension guides 26 provide directional thrust control for the device's forward movement. A plurality of rigidly mounted support braces 30 provide vertical strength to the face sluicing chamber 20. A retractable and extendable rotating ram or guide 38, pivotally mounted to both the face sluicing chamber 20 and the extension and support assembly 28, provides vertical movement control. A plurality of rear injectors 31 extend through the rear bearing support 22 to apply fluids into the collapsed overburden.

Figure 2:
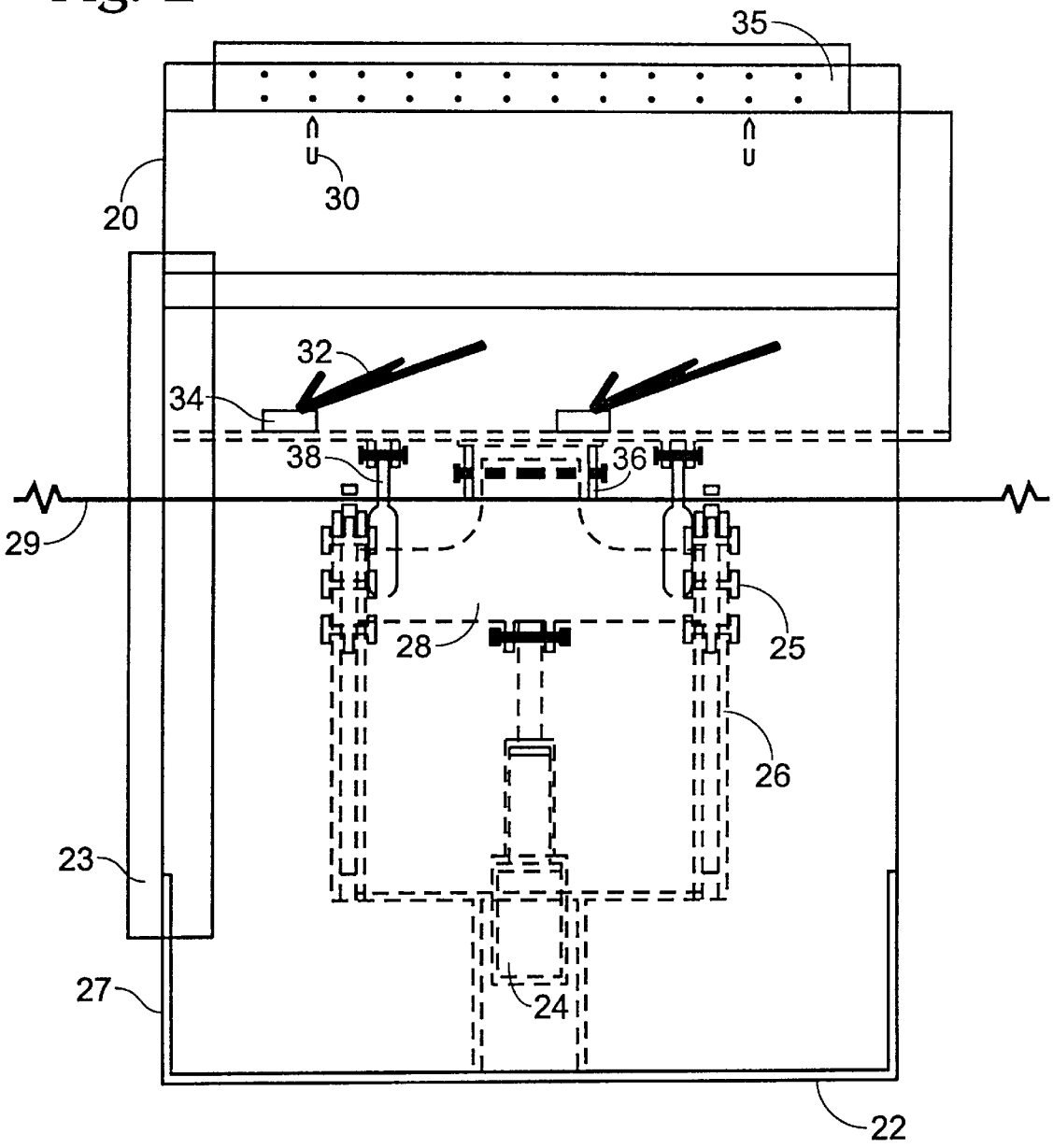
FIG. 2 shows a plan or top view of the softwall mining device of the invention.

FIG. 2 shows the softwall mining device 10 in plan view. The extension and retraction of the face sluicing chamber 20 from the rear bearing support 22 is provided by the extension ram 24 attached fixedly to the rear bearing support 22 and pivotally to the extension and support assembly 28. The extension and support assembly 28 is attached slidingly to both extension guides 26 by means of a plurality of extension and support guide bearing assemblies 25 and directly to the inclined rotating ram 38.

A plurality of pressurized water supply lines and electrical controls 21 (FIG. 3) and water injection control units 34 are attached to face sluicing chamber 20 to provide control of injection fluid pressure and volume. A plurality of pressurized, preferably angularly mounted, injection nozzles 32 fed from each water injection control unit 34 is mounted on the face sluicing chamber 20 to supply fluid injection within the enclosure of the face sluicing chamber 20.

Figure 3:
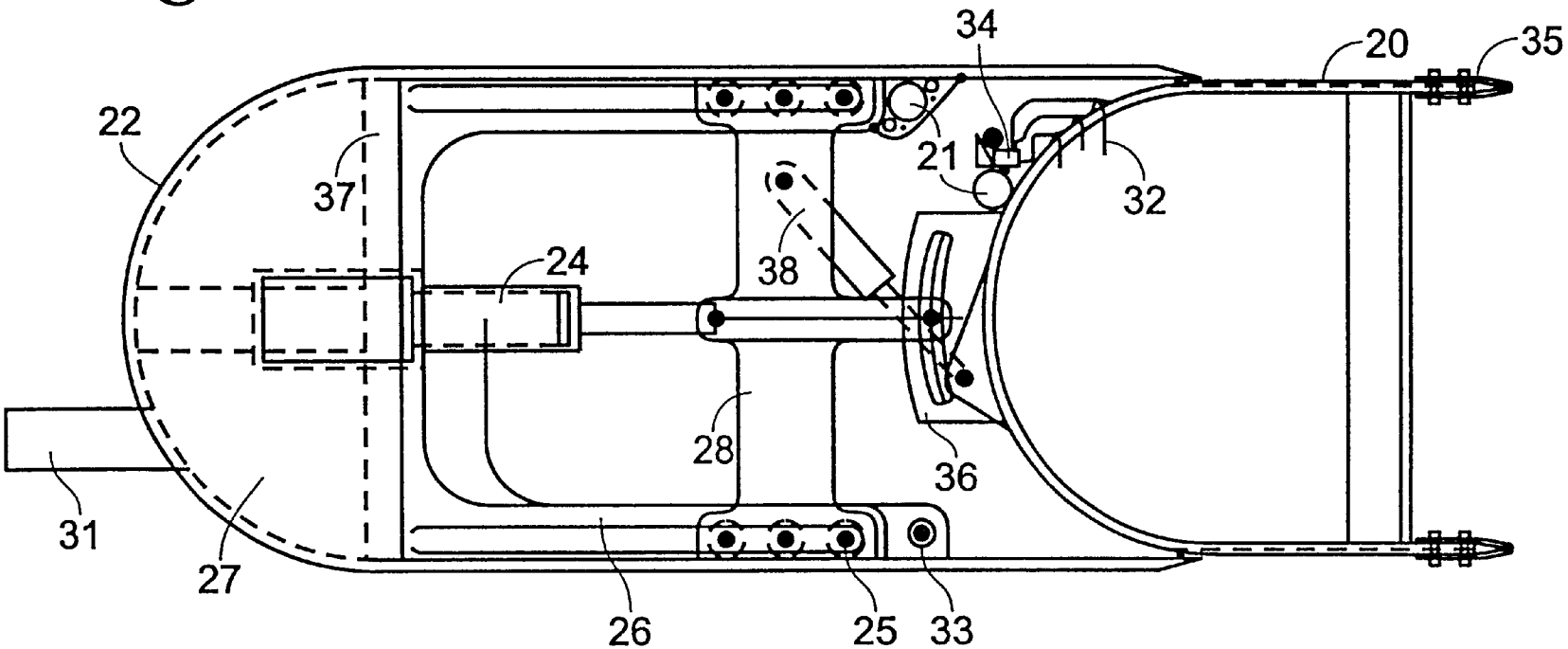
FIG. 3 shows an end view of the softwall mining device of FIGS. 1 and 2.

FIG. 3 is a schematic representation of the cross section of the mining equipment 10.

The leading edge of a rear bearing support 22 is typically beveled to reduce forward resistance. The inclined rotating guide 38 is fixedly connected to the rear portion of the face sluicing chamber 20. A rigid support post 37 is rigidly mounted to the floor and roof of the rear bearing support 22 for strengthening the device. A softwall system control line alignment hole 33 is provided in the extension guides 28. Overlapping side covers 27 are rigidly connected to the rear bearing support 22 to reduce the likelihood of foreign materials entering the device when used in combination with other softwall mining devices.

Figure 4C:
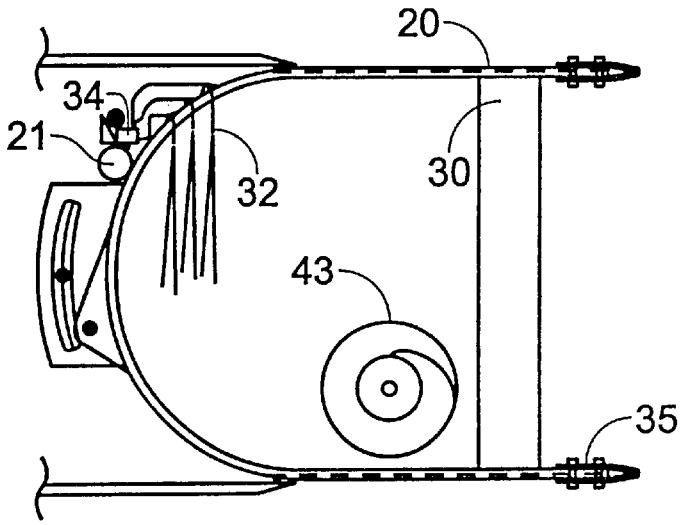
FIG. 4C shows an en d view of the cutting head of a face sluicing chamber including an auger to promote removal of mined material.
Figure 4A:
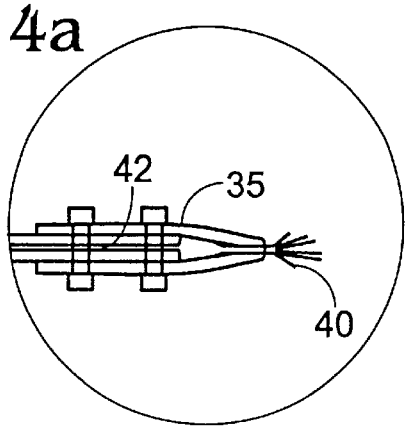
FIG. 4A shows a more detailed view of the top portion of the cutting head seen in FIG. 4.
Figure 4:
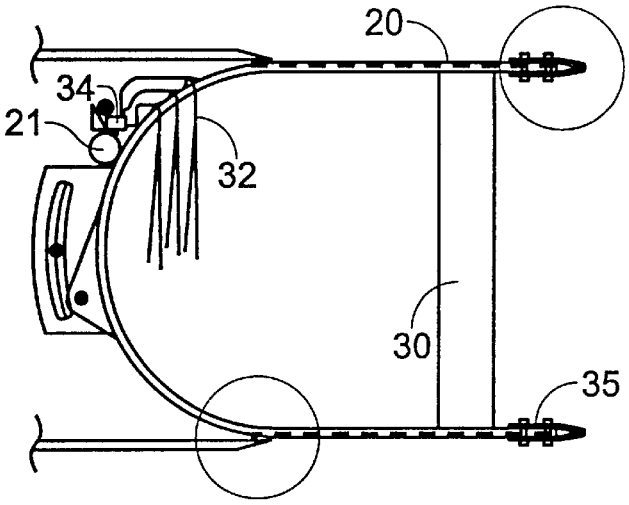
FIG. 4 shows an end view of the cutting head of the face sluicing chamber.
Figure 4B:
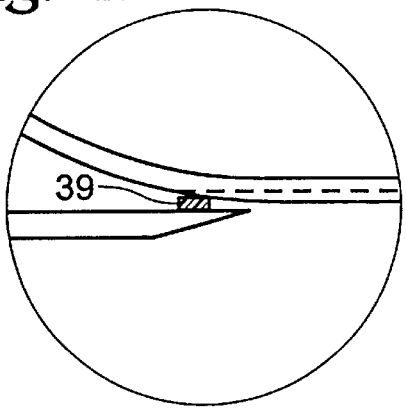
FIG. 4B shows a more detailed view of the bottom portion of the cutting head seen in FIG. 4.

FIG. 4 shows a more detailed side view of the face sluicing chamber 20, with enlarged details shown in FIGS. 4A and 4B. Pressurized injection fluid is delivered to the plurality of water injection control units 34 through the series of pressurized water supply lines and electrical controls 21. The water injection control units 34 are mounted on the outside surface of the face sluicing chamber 20 and distribute pressurized injection fluids to the respective pressurized injection nozzles 32 inside the face sluicing chamber 20. A plurality of nozzles 32 is mounted inside the face sluicing chamber 20 to inject fluids into the ore to break ore from its insitu condition and create a slurry. The face sluicing chamber 20 is preferably machined with a channel inner plate water conduit 42 (FIG. 4A) to provide a conduit for injection fluids to travel from the water injection control units 34 to a penetrating edge orifice 40, where the fluids are injected through multiple cutting-edge injection nozzles 35. The cutting-edge injection nozzles 35 are mounted rigidly on the leading edge of the face sluicing chamber 20 to inject fluids into the ore matrix to aid in penetration. A face sluicing chamber seal 39 (FIG. 4B) provides a seat to prevent external materials from entering the enclosure of the rear bearing support 22.

The invention is based on the idea of removing the soft ore released at the face by slurrying it with pressurized water, but conventional conveying equipment, such as augers and chain conveyors, could be used as well either to evacuate or promote removal of slurried ore from the sluicing chamber. FIG. 4C illustrates such an auger 43 in combination with spray nozzles in the interior of the sluicing chamber 20.

Figure 5:
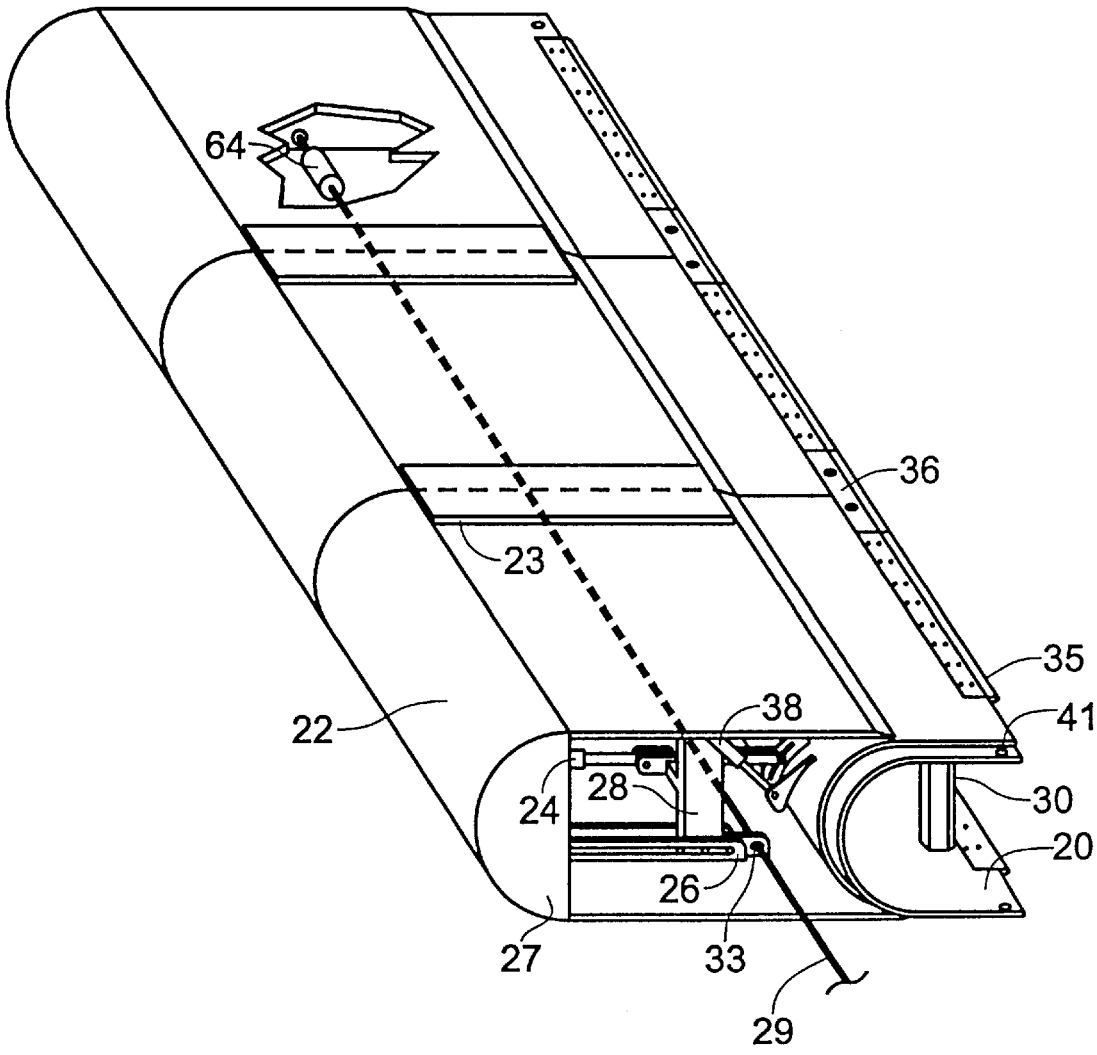
FIG. 5 shows a plurality of softwall mining devices according to the invention connected with a tensioning cable.

FIG. 5 shows in perspective view a plurality of softwall mining devices 10 connected with a softwall system control line 29 through the softwall system control line alignment holes 33. The softwall system control line 29 is secured with a constant tensioning device 64 flexibly attached to the most upstream device in the slurry flow. Adjoining devices 10 are provided with overlapping seals 23 and 36 to minimize leakage of foreign materials into the devices.

Figure 6:
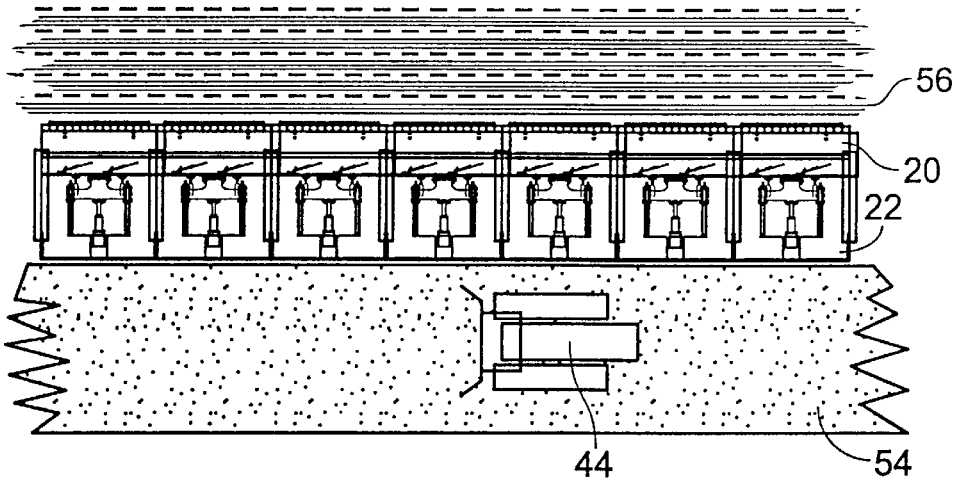
FIGS. 6, 7, and 8 show cooperative action of a plurality of softwall mining devices working together.
Figure 7:
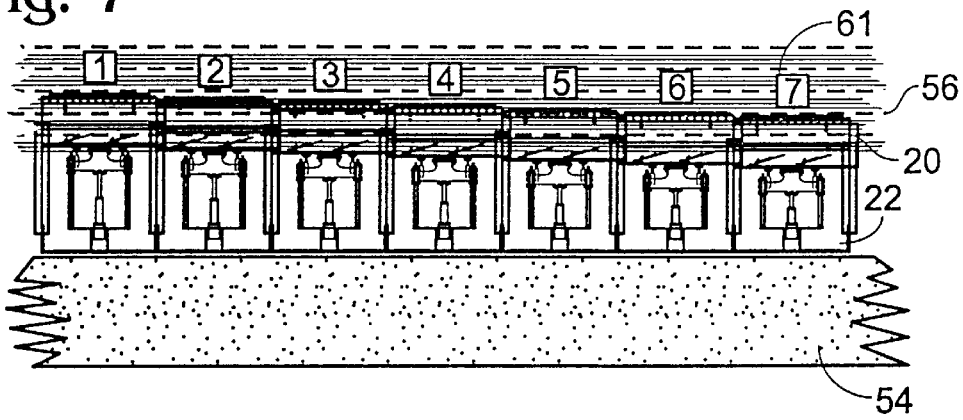
Figure 8:
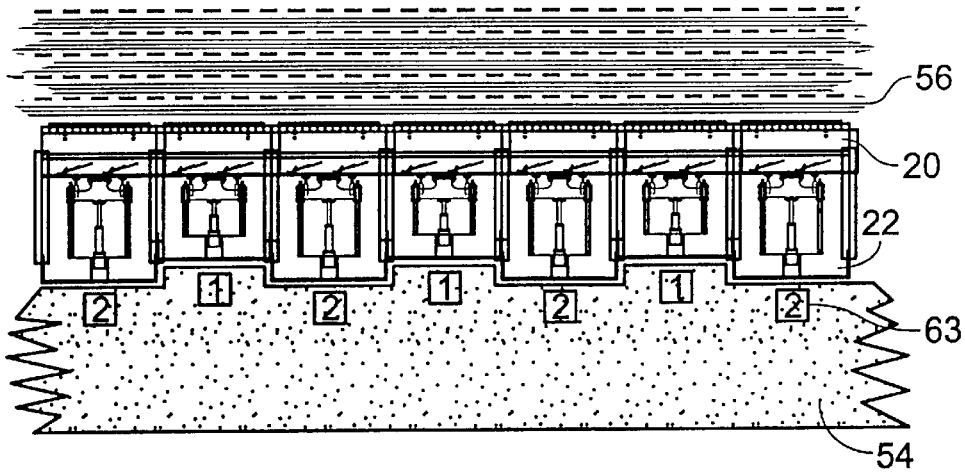

FIGS. 6 through 8 refer to the operation of the softwall mining devices 10 of the invention. There are a number of ways the devices of the invention can be operated. The following illustrations are not meant to be exhaustive but rather to illustrate only some of the possible ways and sequences in which they can be used to recover ore slurry material.

FIG. 6 is a schematic representation in plan view of the first step in the operation of the softwall mining devices 10. The devices are assembled along an ore matrix mining face 56 with full retraction of the face sluicing chambers 20 in preparation for an extension push into the ore matrix mining face 56 against a subsided earthy overburden 54. Surface compaction equipment 44 could be used on the surface for additional overburden compaction.

FIG. 7 is a schematic representation in plan view of a possible second step in the operation of the devices 10 showing an advance sequence of the face sluicing chamber 20 (illustrated by numerals 61) against the uniform alignment of adjacent rear bearing supports 22 bearing against the subsided earthy overburden 54. Prior to advancing into the mining face, the interior portions of the aligned chambers 22 form an open channel through which slurried material can flow. As each chamber is pushed against the mining face with its pressurized injection nozzles 32 operating at fall flow, a portion of the channel is left open for communication with the adjacent chambers, so that the mined ore can flow downstream.

As a result of the extension of the face sluicing chambers 20 into the soft ore matrix, the top leading edges of the chambers penetrate into the ore body and support the overburden, which otherwise would fall in. This support relieves the ore contained within the chambers from the vertical ground pressure at the face. Under these conditions, the forward thrust of the sluicing chambers in combination with the fluidizing action of the pressurized injection fluid produces a volumetric displacement of the soft material in the chambers through the open channel in the downstream chambers and toward the open main trenches. This volumetric displacement and the hydraulic head produced by the injection nozzles enable the slurried ore to flow toward the main trenches even under unfavorable dip conditions of the ore seam. Nevertheless, as would be obvious to one skilled in the art, mining along a down dip is preferred to provide drainage of natural or mining waste water.

Thus, the forward thrust of the sluicing chambers of the invention, utilized in a judiciously selected sequence, produces a pumping action that enables the removal of the ore from the mining face. This approach constitutes a novel concept in mining and is particularly advantageous because it requires the kind of soft, wet and unstable ore conditions that normally render a seam unrecoverable by conventional means.

FIG. 8 is a schematic representation showing a third step in the operation of the softwall mining devices 10 in plan view. In this step, the support units of the rear bearing supports 22 are advanced (i.e., retracted toward the sluicing chambers) in a sequence illustrated, for example, by numerals 63 to show the direction of mining advance, thereby causing subsidence of the earthy overburden 54 behind the devices 10.

The three steps of the mining cycle illustrated above are repeated to provide uninterrupted mining and flow of ore from the mining face. These steps may be repeated either in the same direction or alternatively in opposite directions, if open main trenches are provided at both ends of the face. If necessary in order to create an open channel at the face, all chambers may need to be retracted a short distance from the face before a new push cycle is begun. For very long mining faces, the cycling of the steps will preferably occur in batches among groups of devices feeding multiple main entries at various points along the mining face such that all three steps are substantially contemporaneous at different positions along the face to secure its uniform advancement.

Figure 9:
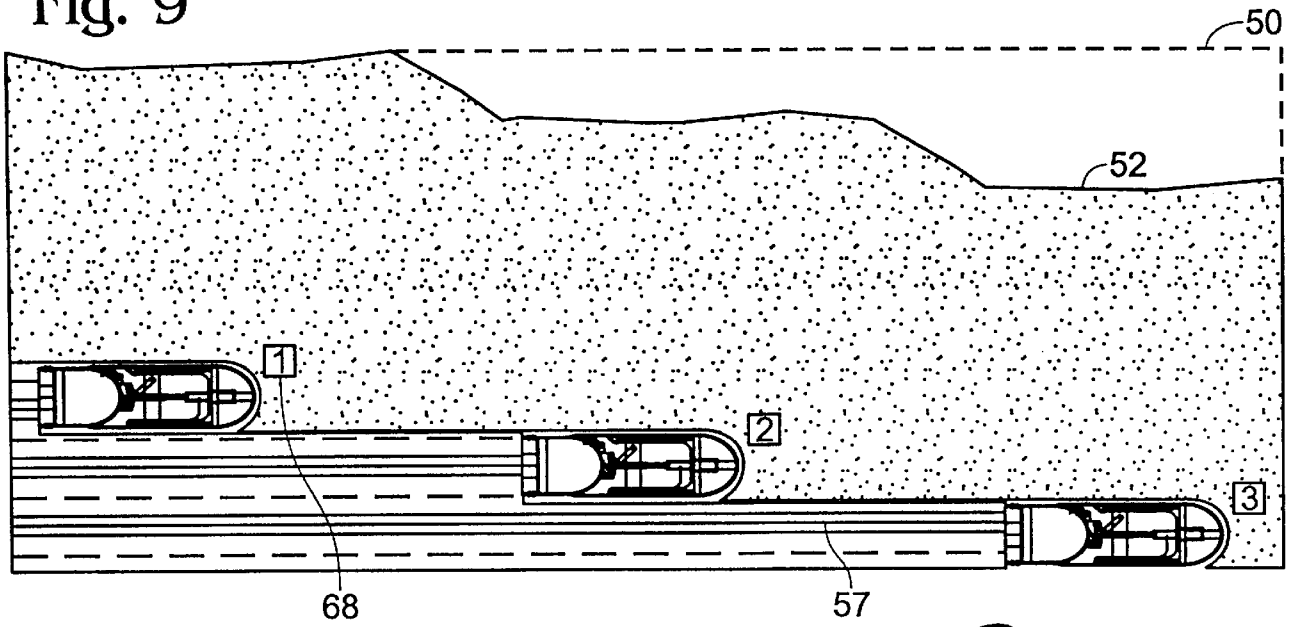
FIG. 9 shows employment of the softwall mining device of the invention in an ore body thicker than the device height.

FIG. 9 shows a multiple lift mining sequence 68 with a softwall mining device 10 or a set of devices in an ore body thicker than the device's height. The same device 10 or set of devices can be used to first mine the top layer of the ore seam and then relocated to mine additional lower layers as desired, the thickness of each layer being substantially equal to the height of the mining device. Alternatively, multiple devices or sets of devices may be arranged as seen in FIG. 9 to sequentially mine each layer downward from the top of the seam. This alternative could be carried out in alternative fashion by operating all sets of mining devices at the same time maintaining the relative position illustrated in the figure. Subsidence of the original overburden surface 50 will occur in stair-step fashion possibly producing a subsided surface 52 as the ore matrix 57 is removed.

Figure 10:
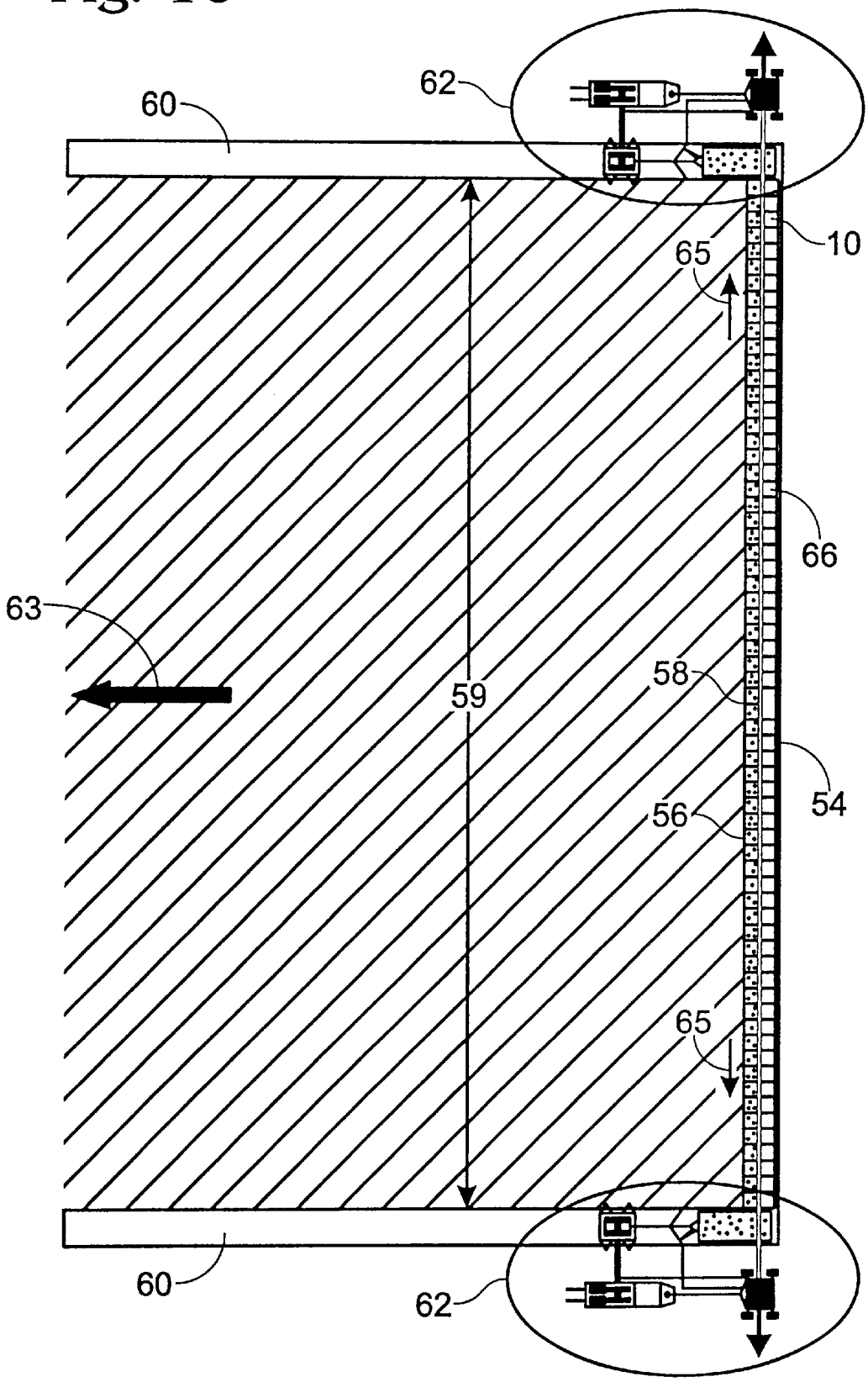
FIG. 10 shows the use of a plurality of the softwall mining devices of the invention with two parallel main trenches and a perpendicular header trench.

FIG. 10 illustrates the use of a plurality of softwall mining devices 10 with two parallel main trenches 60 and a perpendicular header trench 66 extending the fill distance of the panel width 59. A plurality of adjacent softwall mining devices 10 progresses more or less parallel to the ore matrix mining face 56. A closed end 58 in a face sluicing chamber 20 in the middle of the face divides the header trench 66 forcing the slurried ore to follow the flow directions 65 toward the mains 60, where slurried ore is collected by trench-gate slurry handling equipment 62 placed at each main trench's end for transport and processing.

Figure 11:
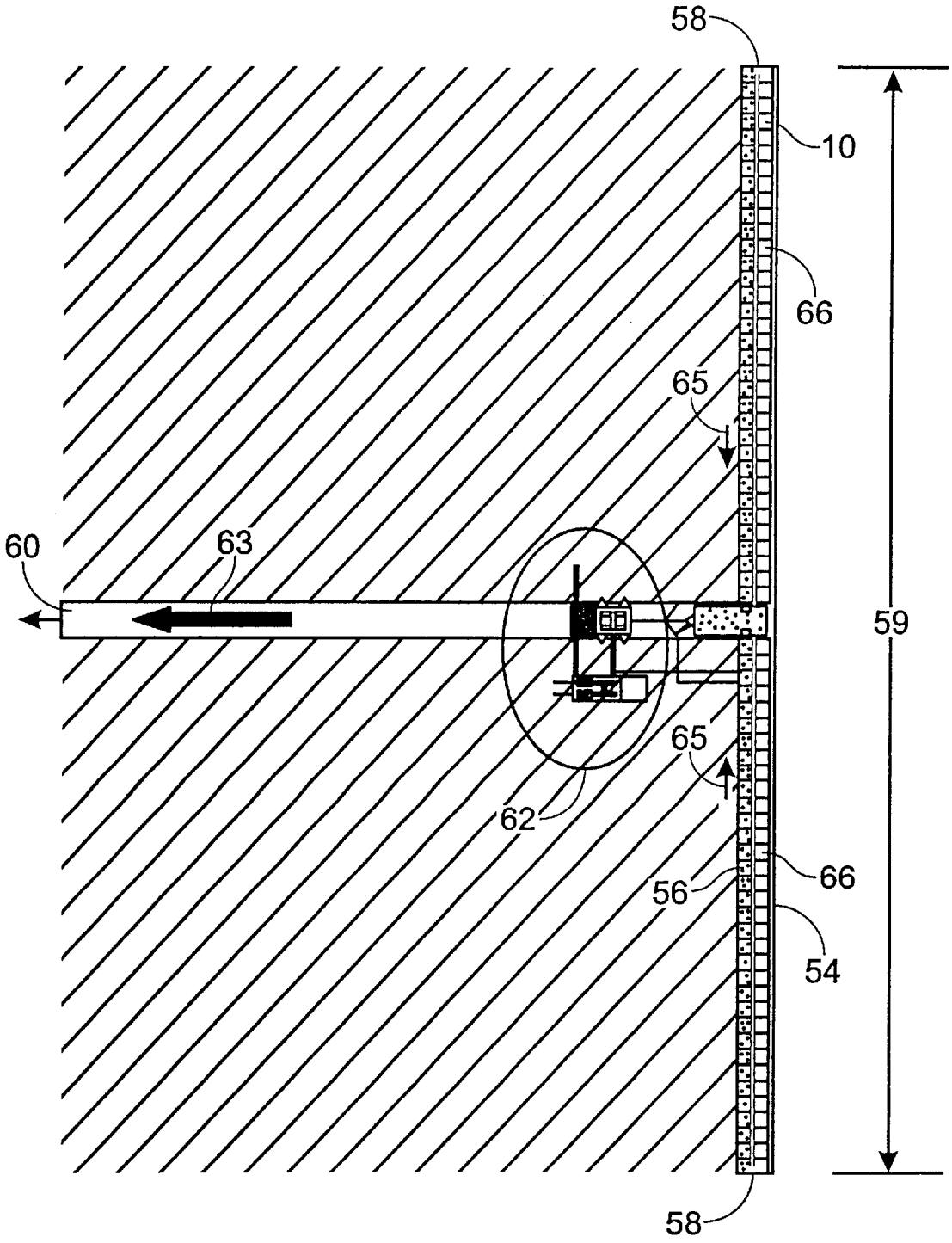
FIG. 11 shows a plurality of softwall mining devices used in an alternative "T" trench configuration.

FIG. 11 shows the use of a plurality of softwall mining devices 10 using an alternative "T" trench configuration with two header trenches 66 feeding into a single main trench 60 excavated during the mine development phase.

In one aspect of the invention, the rear bearing supports 22 are anchored to support advancement of the face sluicing chambers 20 by the weight of the overburden. In another aspect of the invention described below, the mining devices themselves provide some or all of this anchoring function and the devices may be used, for example, in surface mining, windrow reclaim, or other circumstances in which overburden is not present. In this latter aspect, individual devices 10 may be arrayed as shown in FIG. 10 and locked together to provide a relatively large mass to support the advancement of one or more face sluicing chambers.

More particularly, the rear bearing supports 22 of such an array of the devices 10 may be locked together and the face sluicing chambers 20 of the devices 10 may be separately locked together. This provides for a half-cycle of operation of the devices 10 wherein a relatively large number of the rear bearing supports 22 may function as an anchor for advancing, into the mining face, a relatively small number of the face sluicing chambers 20, and another half-cycle of operation wherein the face sluicing chambers are locked together to anchor the advancement toward the mining face of the rear bearing supports.

Figure 12:
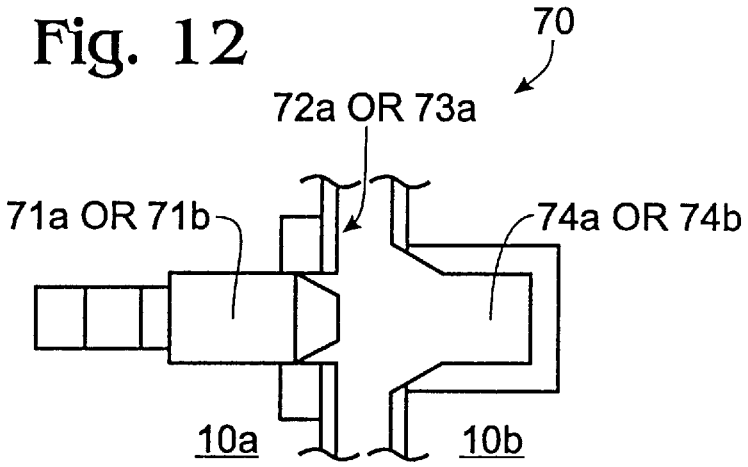
FIG. 12 shows a locking mechanism according to the present invention.

FIG. 12 shows a locking mechanism 70 according to the present invention, for locking together the face sluicing chambers 20 and the rear bearing supports 22 of adjacent devices 10*a* and 10*b*. A slidable pin 71*a* is provided on a side 72*a* of the face sluicing chamber and another similar pin 71*b* is provided on a side 73*a* of the rear bearing 20 support of one of the devices 10*a*. An adjacent device 10*b* includes complementary recesses 74*a*, 74*b* to receive the respective pins, which locks the devices 10 together. Preferably, the pin is tapered to align the devices together at the same time. Each device 10 may include pins on one side and complementary recesses on the other.

Figure 13:
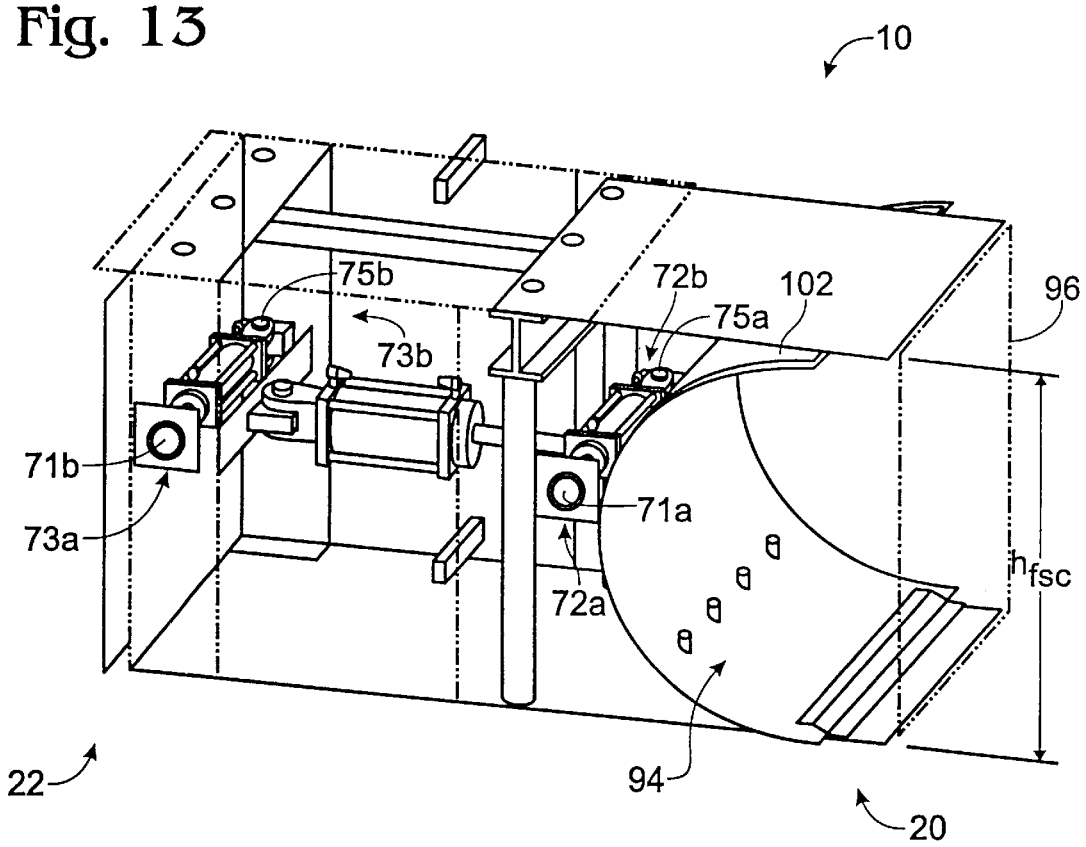
FIG. 13 shows an isometric view of the softwall mining device of FIG. 1, showing the locking mechanism of FIG. 12.

FIG. 13 shows a hydraulically powered piston and cylinder assembly 100 for actuating the pins 71*a* and 71*b*. The assembly 100 of FIG. 13 is double-acting and also actuates pins 75*a* and 75*b* extending from the opposite sides 72*b* and 73*b* of the face sluicing chamber 20 and rear bearing support 22, respectively. Therefore, with the cylinder assembly 100, only half of the devices 10 include pins and the assembly 100, while the other half of the devices include complementary recesses and are spaced therebetween. However, this convenience is not essential to the invention. For example, a single acting assembly in each of the mining devices 10 may be employed.

The cylinder assembly 100 is preferably controlled hydraulically as discussed more fully below. This provides for a number of advantages, including eliminating the need for electricity in an often wet environment.

The devices 10 are preferably tied together through the control line 29 with the aid of the tensioning device 64 (see FIG. 5). This has been found to be important when using the piston and cylinder assembly 100, the control line resisting the tendency for the pin 71 or 75 of one device 10*a* to push the adjacent device 10*b* away.

Figure 14:
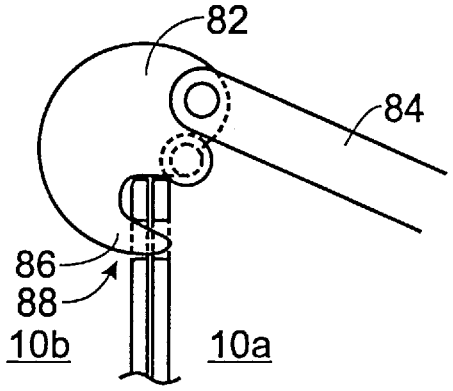
FIG. 14 shows an alternative locking mechanism according to the present invention.

FIG. 14 shows an alternative locking mechanism 80. A cam or hook 82 is pivotally mounted to one of the units 10*a*, the cam being preferably driven by a hydraulically powered and controlled arm 84. The cam has a tooth 86 that is engageable with an aperture 88 in an adjacent device 10*b*. The cam locking mechanism has the advantage that it positively pulls the adjacent devices 10*a* and 10*b* together. Like the pin 71 and/or 75 of the aforedescribed piston and cylinder assembly, the tooth 86 is preferably tapered to provide for aligning the adjacent devices at the same time.

Locking the rear bearing supports 22 of a predetermined number of the devices 10 provides the combined weight of the locked assembly for anchoring the (forward) advancement of the face sluicing chambers 20 of a subset of these devices. The face sluicing chambers are advanced into the mining face by extending the extension ram 24.

A minimum number of the devices 10 can be determined for anchoring the simultaneous advancement of a desired number of face sluicing chambers. For example, a minimum number "Nrb" of the devices may be calculated to provide the mass sufficient to resist, by friction and inertia, the forces applied to a single face sluicing chamber 20 as it advances into the mining face. These forces result primarily from the resistance of the mining face to advancement of the leading edges 19 of the face sluicing chamber 20, and reaction to the flow through the nozzles 32, 35 and to the flow of slurry through the channel that is formed by the interior of the face sluicing chamber 20. Alternative to calculating the number of rear bearing supports that must be locked together, this number may be determined by trial and error. As will be readily appreciated, more of the rear bearing supports 22 may be locked together than is minimally required, and a number of the face sluicing chambers 20 may be advanced at the same time provided there is a corresponding increase in the number of rear bearing supports that are locked together.

In the first half-cycle of operation of the devices 10, the face sluicing chambers 20 of a predetermined number of devices having their rear bearing supports locked together as aforedescribed are advanced or moved forwardly, into the mining face, either one at a time or in relatively small groups (hereinafter "sequentially"). The devices 10 are typically, though not necessarily organized in a linear array such as that shown in FIG. 10, and the devices are typically, though not necessarily, operated in order to provide for the peristaltic pumping discussed above.

When a desired number of adjacent face sluicing chambers 20 have been advanced, the second half-cycle of operation is commenced by locking the face sluicing chambers together to provide an anchor for advancing the rear bearing supports 22 of the devices 10.

Locking the face sluicing chambers 20 of a predetermined number of the devices 10 provides weight for anchoring the advancement of the rear bearing supports 22 of a subset of these devices. The rear bearing supports are advanced toward the face sluicing chambers by contracting the extension ram 24.

A minimum number of the devices 10 can be determined for anchoring the simultaneous advancement of a desired number of rear bearing supports. For example, a minimum number "Nrb" of the devices may be calculated to provide the mass sufficient to resist, by friction and inertia, the forces applied to a single rear bearing support 22 as it advances toward the face sluicing chamber 20. These forces result primarily from the resistance of the earth underneath and above the rear bearing support. Alternative to calculating the number of face sluicing chambers that must be locked together, this number may be determined by trial and error. As will be readily appreciated, more of the face sluicing chambers 20 may be locked together than is minimally required, and a number of the rear bearing supports 22 may be advanced at the same time provided there is a corresponding increase in the number of face sluicing chambers that are locked together.

In the second half-cycle of operation of the devices 10, the rear bearing supports 22 of a predetermined number of devices having their face sluicing chambers locked together as aforedescribed are advanced toward the respective face sluicing chambers, either one at a time or in relatively small groups, i.e., sequentially. Preferably, advancement of the rear bearing supports is by retraction of the extension arm 24; however, other mechanisms may be employed to advance the rear bearing supports without departing from the principles of the invention. The devices 10 are typically, though not necessarily, organized in a linear array such as that shown in FIG. 10, and the devices are typically, though not necessarily, operated in order. When a desired number of rear bearing supports 22 have been advanced, the first half-cycle described above may be repeated.

As mentioned above, the locking mechanisms are preferably operated hydraulically. Hydraulic circuits for this purpose are provided for each of the devices 10 which include a hydraulically operated portion of a locking mechanism, and these circuits are preferably plumnbed in series following the sequence in which such devices are intended to be operated. One specific example of the operation of a circuit according to this principle is given below. As will be readily appreciated by the person of ordinary skill, there are many different ways to realize a hydraulic circuit having the below described mode of operation.

Figure 15:
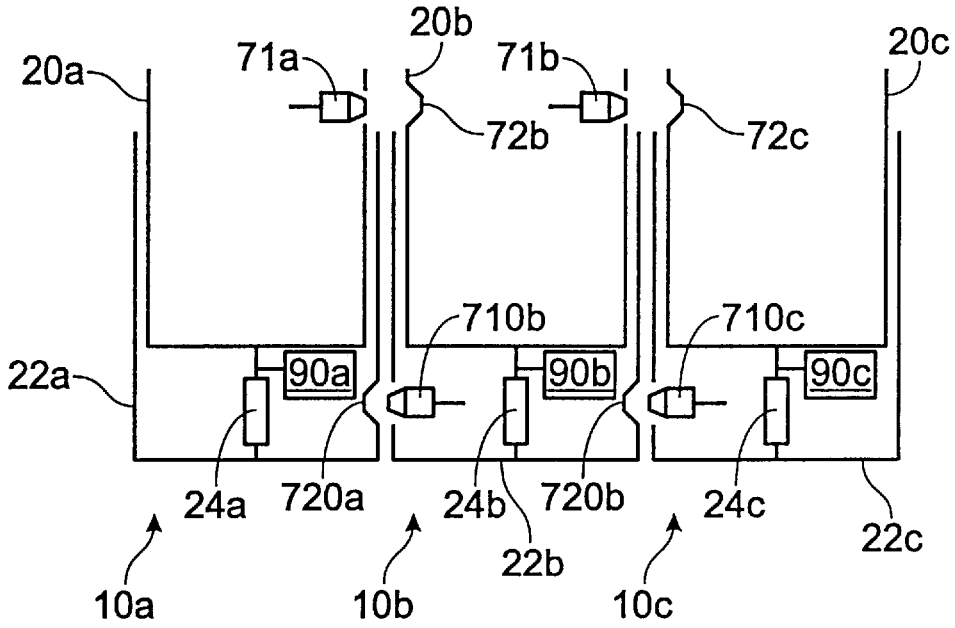
FIG. 15 shows a linear array of mining devices 10 for illustrating an exemplary mode of operating locking mechanisms according to the present invention.

FIG. 15 shows three devices 10, i.e., 10*a*, 10*b* and 10*c*, in a linear array. In this example, devices 10*a* and 10*b* have pins 71*a* and 71*b* for each respective face sluicing chamber and devices 10*b* and 10*c* have corresponding complementary recesses 72*b* and 72*c*. Also, devices 10*b* and 10*c* have pins 710*b* and 710*c* for each respective rear bearing support, and devices 10*a* and 10*b* have corresponding complementary recesses 720*a* and 720*b*. Accordingly, all three devices have a hydraulic circuit, and these are plumbed in series.

Prior to the first half cycle, the rear bearing supports for all of the devices are locked together by extension of the pins 710*a–c* into the recesses 720*a–b*. This provides alignment and anchoring support for the movements that follow. The face sluicing chambers 20*a*–20*c* are unlocked from one another, by retraction of the pins 71*a–b* from the recesses 72*a–b*.

Commencing the first half cycle, the extension ram 24*a* of the device 10*a* extends to advance the corresponding face sluicing chamber 20*a*. When the ram 24*a* reaches full extension, a pressure or position (hereinafter "position") activated valve 90*a* senses this condition and applies fluid to the ram 24*b* of the device 10*b*. This extends the ram 24*b* to advance the corresponding face sluicing chamber 20*b*.

When the ram 24*b* reaches full extension, a position activated valve 90*b* senses this condition and applies fluid to the ram 24*c* of the device 10*c* and to the piston 71*a*. This extends the ram 24*c* to advance the corresponding face sluicing chamber 20*c*, and extends the pin 71*a* into the recess 72*b*, locking the face sluicing chambers 20*a* and 20*b* together.

When the ram 24*c* reaches full extension, a position activated valve 90*c* senses this condition and applies fluid to the pin 71*b*. This extends the pin 71*b* into the recess 72*c*, locking all of the face sluicing chambers together and completing the first half cycle of operation and providing anchoring support for the movements that follow.

Commencing the second half cycle, with the face sluicing chambers of all of the devices locked together, the valve 90*c* applies fluid to the pin 710*c* and to the ram 24*c*. The pin 710*c* retracts to unlock the rear bearing support 22*c* from the rear bearing supports 22*a* and 22*b*, and the ram 24*c* retracts to advance the rear bearing support 22*c* toward the face sluicing chamber 20*c*.

When the ram 24*c* reaches full retraction, a position activated valve (preferably the valve 90*c*) applies fluid to the pin 710*b* and the ram 24*b*. The pin 710*b* retracts to unlock the rear bearing support 22*b* from the rear bearing support 22*a*, and the ram 24*b* retracts to advance the rear bearing support 22*b* toward the face sluicing chamber 20*b*.

When the ram 24*b* reaches full retraction, a position activated valve (preferably the valve 90*b*) applies fluid to the pin 710*c* and the ram 24*a*. The pin 710*c* extends into the recess 720*b* to lock the rear bearing supports 22*b* and 22*c* together and the ram 24*a* retracts to advance the rear bearing support 22*a* toward the face sluicing chamber 20*a*.

When the ram 24*a* reaches full retraction, a position activated valve (preferably the valve 90*a*) applies fluid to the pin 710*b*, which extends into the recess 720*a* to lock all of the rear bearing supports together, completing the second half cycle.

With the second half cycle completed, the first half cycle is ready to be repeated. Though a specific example of control of the devices 10 has been provided, many alternative modes of operation of the devices 10 according to the general principles of the invention are possible and will be readily apparent to those of ordinary skill in light of the example. For example, the double acting pins discussed above may be employed, and separately controlled electric or hydraulic circuits may be provided for operating the extension ram 24 and the pins.

Preferably, at the same time that the face sluicing chambers 20 are advanced by extending the corresponding extension rams 24 of the devices 10, the hydraulic circuit provides for injecting water through the injection nozzles 32 (FIG. 4) of the same device 10. As the sluicing chambers of adjacent devices are successively moved, the simultaneous injection of water provides for pumping action on the slurry that results. In that regard, the peristaltic pumping action provided by sequentially operating adjacent devices 10 may commence in the center of the array and move outwardly toward one or both sides, to decrease the pumping distance.

Returning to FIG. 13, a semi-cylindrical channel portion 94 is formed between the face sluicing chamber 20 of a single device 10 and a mining face 96. An array of the devices produces a channel 99 (FIG. 5) that comprises the sum of the channel portions of all of the devices. In FIG. 13, where only one mining device is shown, the channel is defined by the channel portion 94. The channel carries off the slurry that is produced at the mining face. The channel is preferably lined with a flexible lining, a portion of which corresponds to the device 10 in FIG. 13, indicated as 102. Preferably, the lining is substantially continuous across at least a plurality of the devices and, more preferably, it is continuous across all of the devices to prevent slurry and mining fluids from entering the rear bearing supports through spaces between the adjacent devices. The lining is flexible to permit relative advancement of the face sluicing chambers 20 of adjacent devices without rupture. The lining smooths the channel during the time that adjacent face sluicing chambers in the array are displaced with respect to one another.

Figure 16:
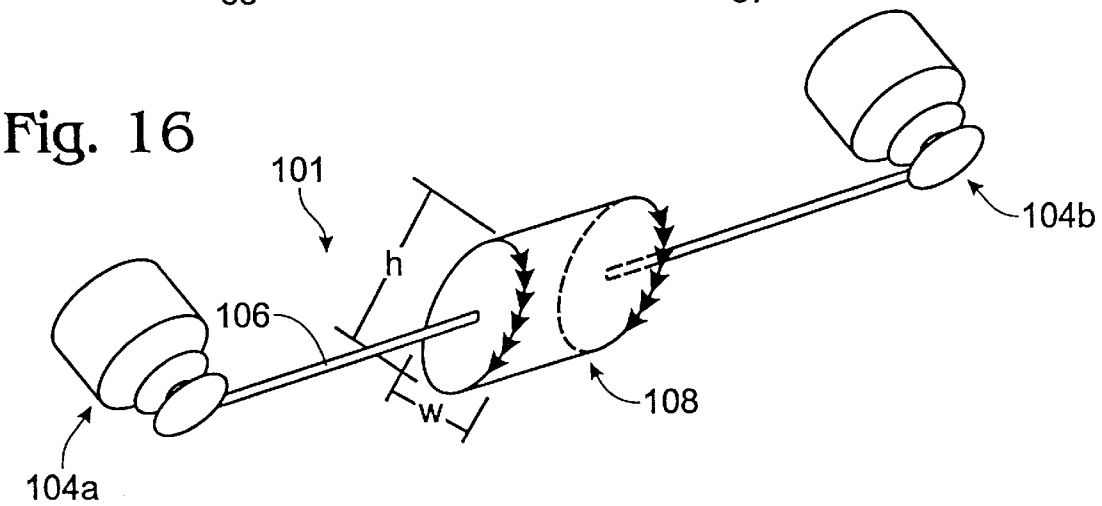
FIG. 16 shows a channel swab according to the present invention.

FIG. 16 shows a swab 101 for use in the channel 99. The swab comprises a pair of bi-directional winches 104*a*, 104*b* driving a flexible line 106 through the channel. Attached to the line 106 is a clearing member 108. The face sluicing chambers have a predetermined stroke, provided by the extension ram 24. The stroke may be selected according to conditions to provide a desired pumping action and speed as will readily be appreciated by the person of ordinary skill. The swab 101 has a width "w" that is preferably about as wide as this stroke and a height "h" that is about twice this width for a face sluicing chamber having a height "$h_{fsc}$" (see FIG. 13). The swab is thereby adapted to bore a relatively small conduit through the channel. However, the swab 101 may have any other desired dimensions relative to the size of the channel portion 94 (FIG. 13) without departing from the principles of the invention.

The swab may be employed for clearing obstructions in the channel 99 and can be run forwardly or backwardly through the channel for this purpose. Use of the swab may also be coordinated with the movements of the devices 10 to provide a conduit for slurry flow in case the channel should fill with mud. For example, if a linear array of the devices 10 is arranged to advance sequentially into the mine face from left to right, the swab may be positioned to the left of the first device in the sequence and be moved from left to right in unison, lagging behing the movement of the adjacent face sluicing chamber 20. On the next pass, the conduit formed by movement of the swab 101 ensures that slurry will be able to flow.

The swab also provides some degree of backflow resistance, to direct the flow of slurry in the preferred direction. In addition, FIG. 17 shows a side cover 104 for use with a selected one of the devices to completely obstruct the channel at that device and prevent flow past the device in either direction.

Figure 17:
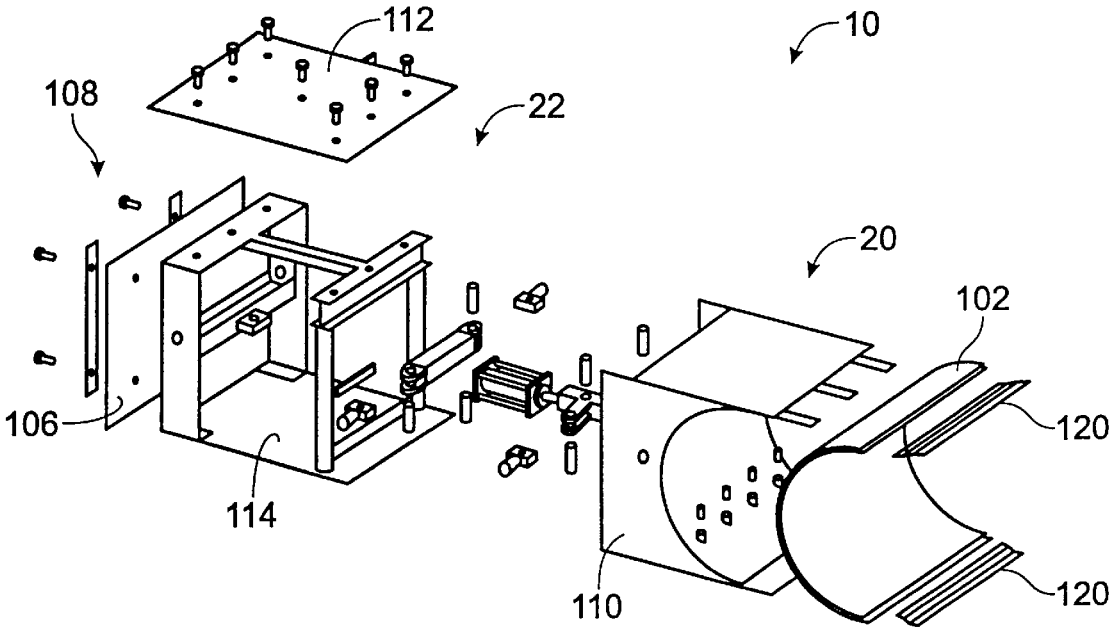
FIG. 17 shows an exploded view of a softwall mining device 10 according to the present invention.

FIG. 17 shows an exploded view of one of the devices 10. A plate 110 is applied to one or both sides of face sluicing chamber 20 to provide structural support for supporting overburden. The plate(s) 110 may be used to replace the structural supports 30 (FIG. 1) and provide the advantage of leaving the channel 100 clear of structural obstruction. The supports 30 have in the past included cutting edges to permit the supports to penetrate the mining face, therefore providing for greater penetration by the face sluicing chamber. Eliminating the struts removes the need for these additional cutting edges. Therefore, the plate 110 provides that the force applied by the face sluicing chamber against the mining face is distributed over a smaller number of cutting edges 120, increasing the cutting or penetrating pressure.

A portion 106 of a second flexible lining that covers back portions 108 of the rear bearing supports 22 protects the back portions from entry of mud and other debris into the rear bearing supports. Like the flexible lining of which the portion 102 corresponding to the mining device 10 is shown, the flexible lining of which the portion 106 is shown is sufficiently flexible to permit relative movement of adjacent mining devices without rupture.

Figure 18:
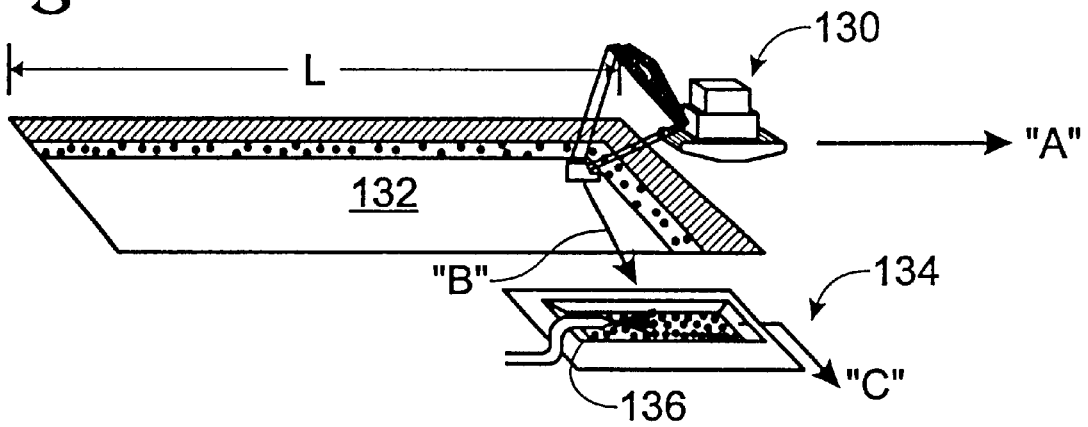
FIG. 18 shows a pictorial view of a prior art dragline and sluicing operation for windrow reclaim.

FIG. 18 shows a pictorial view of a prior art dragline and sluicing operation for windrow reclaim. The example is illustrative of a problem that is present in surface mining generally. A dragline excavator 130 excavates a mining pit 132. The dragline generally progresses in the direction shown by the arrow "A." A sluicing pit 134 is provided adjacent the mining pit. As the dragline removes earth from the mining pit, it deposits the earth into the sluicing pit (in the direction of the arrow "B"). A water canon or other water delivery system 136 is provided at the sluicing pit to turn the excavated earth into a slurry so that the earth may be pumped away to a point of collection (along "C").

One problem with this prior art method is that the sluicing pit is often a bottleneck in the flow of earth from the pit to the ultimate point of pumping of the slurry. If the pit is full, the dragline must wait to deposit more excavated earth. Another problem with the method is that the sluicing pit becomes out of reach of the dragline as the dragline travels along the direction "A" and the length "L" of the mining pit increases as a result. To solve this problem, the pit is periodically reconstructed to move with the dragline; however, this is costly and time consuming.

Figure 19:
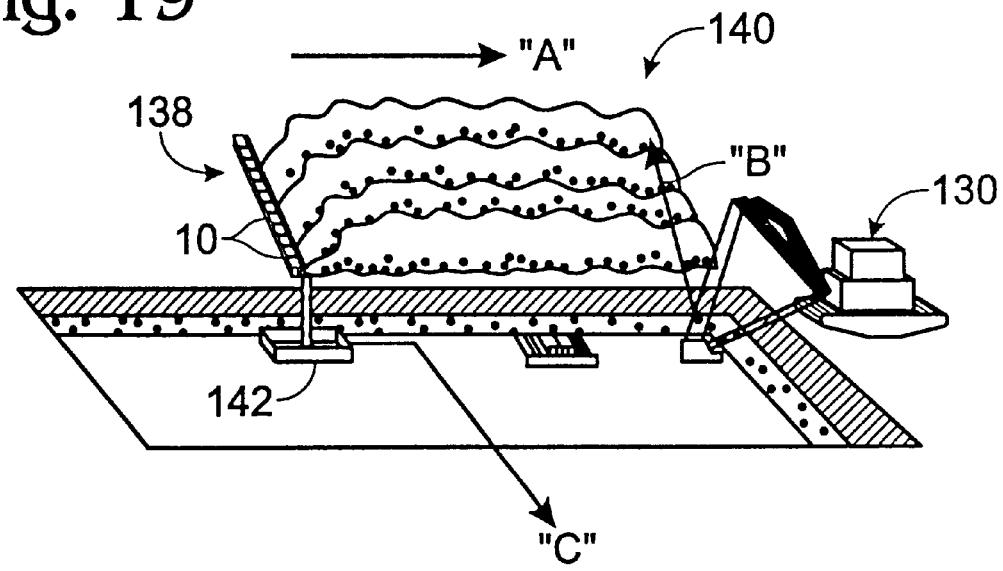
FIG. 19 shows a pictorial view of a dragline and sluicing operation for windrow reclaim according to the present invention.

FIG. 19 shows a pictorial view of a dragline and sluicing operation for windrow reclaim according to the present invention. The dragline 130 moves the excavated earth (along the direction of the arrow "B") to the side of the mining pit as the dragline travels in the direction of the arrow "A", creating a pile 140 of excavated earth. An array 138 of softwall mining devices 10 is provided to transform the pile into slurry and to move the slurry to a slurry collection and pumping station 142 for pumping the slurry to a point of collection (along "C"). An outstanding advantage of the method is that it decouples the excavation from the creation and pumping of the slurry, so that the latter cannot slow the rate of the former. The array 138 may be operated simultaneously with operation of the dragline, or it may be operated at any other time without impacting the operation of the dragline.

A method according to the invention for windrow reclaim having been described, it should be understood that there is no intention to limit the invention to windrow reclaim. Rather, the method may be employed in any desired surface or other mining application.

Returning to FIG. 17, for sub-surface mining a top cover 112 (and bottom cover 114) are included in the rear bearing support to protect the rear bearing support and to provide structural rigidity and strength. However, for surface mining, windrow reclaim and similar mining operations, at least the top cover may be eliminated or employed as a foundation for an additional water canon or water nozzle.

Figure 20:
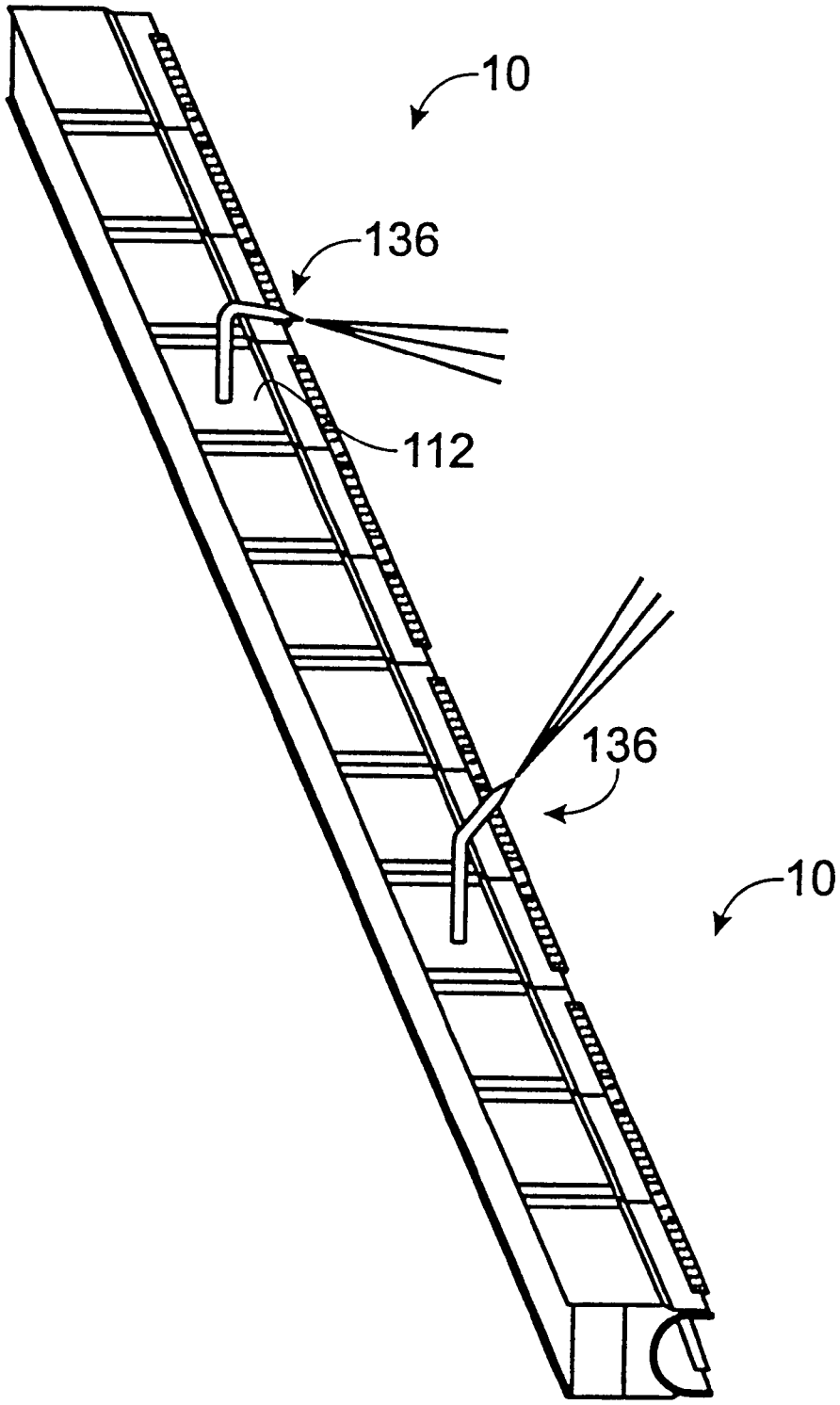
FIG. 20 shows a pictorial view of an array of longwall mining devices wherein selected devices have a water canon mounted thereon according to the present invention.

FIG. 20 shows selected mining devices 10 provided with a water canon or other water delivery system 136, preferably on the rear bearing supports 22 and more particularly on or in the location of the top cover 112, which may be omitted. The water canon may be used, for example, in the windrow reclaim operation discussed immediately above, or in other surface mining operations. While the water canon is not essential, the present inventors have recognized that the mining devices 10 provide an advantageous platform for the water canon 136, which may be used to assist the face sluicing chambers 20 of the mining devices 10 to transform the windrow to slurry.

It should be appreciated that an outstanding advantage of the softwall mining devices 10 results from providing for controlling the amount of moisture added to excavated earth or ore for forming a slurry. The control afforded by the devices 10 when used for sub-surface mining provides for a slurry of phosphate bearing clay, for example, at 35 to 40% solids content, which represents about a 5–20% improvement over the prior art. This results from sealing the mining face with the face sluicing chambers 20, preventing the entry of sub-surface water. For windrow reclaim, the ore is taken out of the pit where it would otherwise be mixed with water, and the water drains back into the pit, leaving the ore relatively dry. Then, the water canon may be employed to add back just the amount of water necessary to flow the ore from the site.

Various changes in the details, steps and materials that have been described may be made by those skilled in the art within the principles and scope of the invention herein illustrated and defined in the appended claims. Therefore, while the present invention has been shown and described in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus and methods.

We claim:

1. A method for mining comprising the steps of providing a plurality of mining devices each comprising a supporting portion, an earth moving portion, and a coupling mechanism operably providing for increasing and decreasing the separation therebetween and thereby for advancing the earth moving portion with respect to the supporting portion into a mining face and the supporting portion toward the earth moving portion, selecting a first mining device of said plurality of mining devices for advancement, operating a locking mechanism that releasably locks the supporting portion of said first mining device to supporting portions of other of said plurality of mining devices to which the supporting portion of said first mining device was not previously locked by said mechanism to anchor said advancement, and operating the coupling mechanism of said first mining device for advancing the earth moving portion of said first mining device ahead of the respective supporting portion.

2. The method of claim 1, wherein said locking mechanism comprises at least one of a locking pin and a complementary aperture adapted to receive the locking pin of an adjacent one of said plurality of mining devices, wherein the method further comprises selecting one of said plurality of mining devices that is adjacent said first mining device, and wherein said step of operating said locking mechanism includes extending the locking pin of one of said mining devices into the aperture of the selected said one of said plurality of mining devices that is adjacent said first mining device.

3. The method of claim 1, wherein said locking mechanism comprises at least one of a pivotally mounted hook and a complementary aperture adapted to receive the hook of an adjacent one of said plurality of mining devices, wherein the method further comprises selecting one of said plurality of mining devices that is adjacent said first mining device, and wherein said step of operating said locking mechanism includes pivoting the hook of one of the mining devices into the aperture of the selected said one of said plurality of mining devices that is adjacent said first mining device.

4. The method of claim 1, wherein said locking mechanism includes, in about half of said plurality of mining devices, a movable member and, in the about the other half of said plurality of mining devices, an aperture for receiving at least a portion of the movable member of an adjacent one of said plurality of mining devices, wherein the method further comprises selecting one of said plurality of mining devices that is adjacent said first mining device, and wherin said step of operating said locking mechanism includes inserting at least a portion of the movable member of one of the said plurality of mining devices into said at least a portion of the aperture of the selected said one of said plurality of mining devices that is adjacent said first mining device.

5. The method of claim 1, further comprising selecting a second of said plurality of mining devices for advancement and sequentially operating the coupling mechanism of said second of said plurality of mining devices for advancing the earth moving portion of said second of said plurality of mining devices ahead of the respective supporting portion.

6. The method of claim 5, wherein said step of selecting said second of said plurality of mining devices comprises selecting one of said plurality of mining devices that is adjacent to said first mining device.

7. The method of claim 6, further comprising selecting a third of said plurality of mining devices for advancement and sequentially operating the coupling mechanism of said third of said plurality of mining devices for advancing the earth moving portion of said third of said plurality of mining devices ahead of the respective supporting portion.

8. The method of claim 7, wherein said step of selecting said third of said plurality of mining devices comprises selecting one of said plurality of mining devices that is adjacent said second of said plurality of mining devices.

9. The method of claim 7, wherein said step of selecting said third of said plurality of mining devices comprises selecting a remaining one of said plurality of mining devices that is adjacent said second of said plurality of mining devices.

10. The method of claim 5, wherein the respective earth moving portions of said first and second of said plurality of mining devices are advanced with respect to the respective supporting portions, the method further comprising releasably locking the respective earth moving portions of said first and second of said plurality of mining devices together, selecting one of said first and second of said plurality of mining devices, unlocking the supporting portion of said selected one of said first and second of said plurality of mining devices, and operating the coupling mechanism of said selected one of said first and second of said plurality of mining devices to advance the supporting portion thereof toward the respective earth moving portion.

11. The method of claim 10, further comprising unlocking the supporting portion of the other of said first and second of said plurality of mining devices, and sequentially operating the coupling mechanism of said other of said first and second of said plurality of mining devices to advance the supporting portion thereof toward the respective earth moving portion.

12. A method for mining comprising the steps of providing a plurality of mining devices each comprising a supporting portion, an earth moving portion, and a coupling mechanism operably providing for increasing and decreasing the separation therebetween and thereby for advancing the earth moving portion with respect to the supporting portion into a mining face and the supporting portion toward the earth moving portion, selecting a first of said plurality of mining devices for advancement, operating a locking mechanism that releasable locks the earth moving portion of said first mining device to earth moving portions of other of said plurality of mining devices to which the earth moving portion of said first mining device was not previously locked by said mechanism to anchor said advancement, and operating the coupling mechanism of said first mining device for advancing the supporting portion of said first mining device toward the respective earth moving portion.

13. The method of claim 12, further comprising selecting a second one of said plurality of mining devices for advancement and sequentially operating the coupling mechanism of said second of said plurality of mining devices for advancing the supporting portion of said second of said plurality of mining devices toward the respective earth moving portion.

14. The method of claim 13, wherein said step of selecting said second of said plurality of mining devices comprises selecting one of said plurality of mining devices that is adjacent to said first of said plurality of mining devices.

15. The method of claim 13, further comprising selecting a third of said plurality of mining devices for advancement and sequentially operating the coupling mechanism of said third of said plurality of mining devices for advancing the supporting portion of said third of said plurality of mining devices ahead of the respective earth moving portions.

16. The method of claim 15, wherein said step of selecting said third of said plurality of mining devices comprises selecting one of said plurality of mining devices that is adjacent said second of said plurality of mining devices.

17. The method of claim 15, wherein said step of selecting said third of said plurality of mining devices comprises selecting a remaining one of said plurality of mining devices that is adjacent said second of said plurality of mining devices.

18. The method of claim 13, wherein the respective supporting portions of said first and second of said plurality of mining devices are advanced with respect to the respective earth moving portions, the method further comprising releasably locking the respective supporting portions of said first and second of said plurality of mining devices together, selecting one of said first and second of said plurality of mining devices, unlocking the earth moving portion of the selected one of said first and second of said plurality of mining devices, and operating the coupling mechanism of said selected one of said first and second of said plurality of mining devices to advance the earth moving portion thereof ahead of the respective supporting portion.

19. The method of claim 18, further comprising unlocking the earth moving portion of the other of said first and second of said plurality of mining devices, and sequentially operating the coupling mechanism of said other of said first and second of said plurality of mining devices to advance the earth moving portion thereof ahead of the respective supporting portion.

* * * * *